US007437867B2

(12) United States Patent
Sawada

(10) Patent No.: US 7,437,867 B2
(45) Date of Patent: Oct. 21, 2008

(54) CORE YARN PRODUCTION METHOD AND APPARATUS

(75) Inventor: Harutoshi Sawada, Charlotte, NC (US)

(73) Assignee: Murata Kikai Kabushiki Kaisha, Kyoto (JP)

( * ) Notice: Subject to any disclaimer, the term of this patent is extended or adjusted under 35 U.S.C. 154(b) by 204 days.

(21) Appl. No.: 11/435,406

(22) Filed: May 17, 2006

(65) Prior Publication Data

US 2006/0277892 A1 Dec. 14, 2006

(30) Foreign Application Priority Data

May 25, 2005 (JP) ..... 2005-152271

(51) Int. Cl.
*B65H 69/06* (2006.01)

(52) U.S. Cl. ..... 57/3; 57/22

(58) Field of Classification Search ..... 57/3, 57/6, 19, 22

See application file for complete search history.

(56) References Cited

U.S. PATENT DOCUMENTS 2,990,673 A 7/1961 Adkins
3,913,308 A 10/1975 Lemaire
4,614,081 A 9/1986 Kim
6,370,858 B1 * 4/2002 Mori ..... 57/6
2002/0139102 A1 * 10/2002 Kawabata ..... 57/6
2006/0096271 A1 * 5/2006 Yamamoto et al. ..... 57/350

FOREIGN PATENT DOCUMENTS

JP 2002-363834 12/2002

* cited by examiner

*Primary Examiner*—Shaun R Hurley
(74) *Attorney, Agent, or Firm*—Kirschstein et al.

(57) ABSTRACT

An elastic core fiber is caught to prevent production of a core yarn having no elastic core fiber. In a method for producing a core yarn by supplying a sliver to a drafting device in a predetermined amount and merging a core fiber with the sliver, the sliver is supplied to the drafting device in an amount greater than the predetermined amount over a predetermined period of time after spinning is started, so as to merge with the core fiber, and thereafter, the sliver is supplied to the drafting device in the predetermined amount. Preferably, the amount of sliver that is supplied to the drafting device is changed in accordance with the rotational speed of predetermined draft rollers in the drafting device.

4 Claims, 4 Drawing Sheets

CORE YARN PRODUCTION METHOD AND APPARATUS

BACKGROUND OF THE INVENTION

1. Field of the Invention

The present invention relates to a core yarn production method and apparatus, which ensures that a core fiber is included in a core yarn.

2. Description of the Background Art

An exemplary apparatus for producing a core yarn having an elastic core fiber provided in a bundle of fibers is a core yarn production apparatus as disclosed in Japanese Laid-Open Patent Publication No. 2002-363834 ("air sucker device 58" in FIG. 4 and paragraph 0035). The production apparatus uses an elastic fiber as a core fiber, which is supplied from an elastic core fiber supply device, and a bundle of fibers as a covering fiber, which is drafted by a drafting device, and produces a core yarn by performing air spinning using a spinning device. The elastic core fiber supply device includes an air sucker device from which a jet of high pressure air is emitted to merge the elastic core fiber with the bundle of fibers.

In the case of producing a fine count core yarn with the above-described core yarn production apparatus, however, the amount of sliver that is supplied to the drafting device is low, resulting in a bundle of fibers having a narrow width, and the bundle of fibers in the drafting device may be disturbed due to the high pressure air from the air sucker device, so that the bundle of fibers fails in catching and merging with the core fiber from the core fiber supply device. This often causes the core fiber to wrap around the front bottom roller (which is called "bottom wrap"), so that a yarn having no core fiber is taken up onto a package.

SUMMARY OF THE INVENTION

The present invention solves the problem of providing, in consideration of the above situation, a core yarn production method and apparatus, which ensures that an elastic core fiber from an elastic core fiber supply device can be caught by a bundle of fibers, thereby reducing the frequency of spinning a yarn having no core.

To solve the above-mentioned problem, in a core yarn production method according to the present invention for producing a core yarn by supplying a sliver to a drafting device in a predetermined amount and merging a core fiber with the sliver, the sliver is supplied to the drafting device in an amount greater than the predetermined amount over a predetermined period of time after spinning is started, so as to merge with the core fiber, and thereafter, the sliver is supplied to the drafting device in the predetermined amount.

Also, in a core yarn production apparatus according to the present invention for producing a core yarn by supplying a sliver to a drafting device in a predetermined amount and merging a core fiber with the sliver, the apparatus comprising: means for changing an amount of sliver that is supplied to the drafting device; and means for controlling timing of the changing, under control of the controlling means, the sliver is supplied to the drafting device in an amount greater than the predetermined amount over a predetermined period of time after spinning is started, so as to merge with the core fiber, and thereafter, the sliver is supplied to the drafting device in the predetermined amount.

Preferably, the amount of sliver that is supplied to the drafting device is changed in accordance with the rotational speed of predetermined draft rollers in the drafting device.

As described above, when producing a fine count core yarn, etc., the amount of sliver that is supplied to the drafting device is increased over a predetermined period of time after spinning is started. By increasing the amount of sliver in this manner, it is made possible to reduce disturbance of a bundle of fibers due to high pressure air from an air sucker device, and increase the width of the bundle of fibers in the drafting device. As a result, it is ensured that a core fiber from a core fiber supply device is caught and merged with the bundle of fibers. Therefore, even in the case of producing a fine count core yarn, etc., it is possible to ensure prevention of taking up a core yarn having no core.

Also, the amount of sliver that is supplied to the drafting device is changed by adjusting the rotational speed of predetermined draft rollers in the drafting device. For example, back rollers and third rollers of a core yarn spinning machine can be adjusted in speed for each spinning unit, and therefore, even in the case of performing yarn splicing with a predetermined spinning unit, the amount of sliver that is supplied can be readily changed for a predetermined period of time after spinning is started.

DESCRIPTION OF THE PREFERRED EMBODIMENTS

Hereinafter, a core yarn production method and apparatus according to the present invention will be described in detail with reference to the accompanying drawings.

Figure 1:
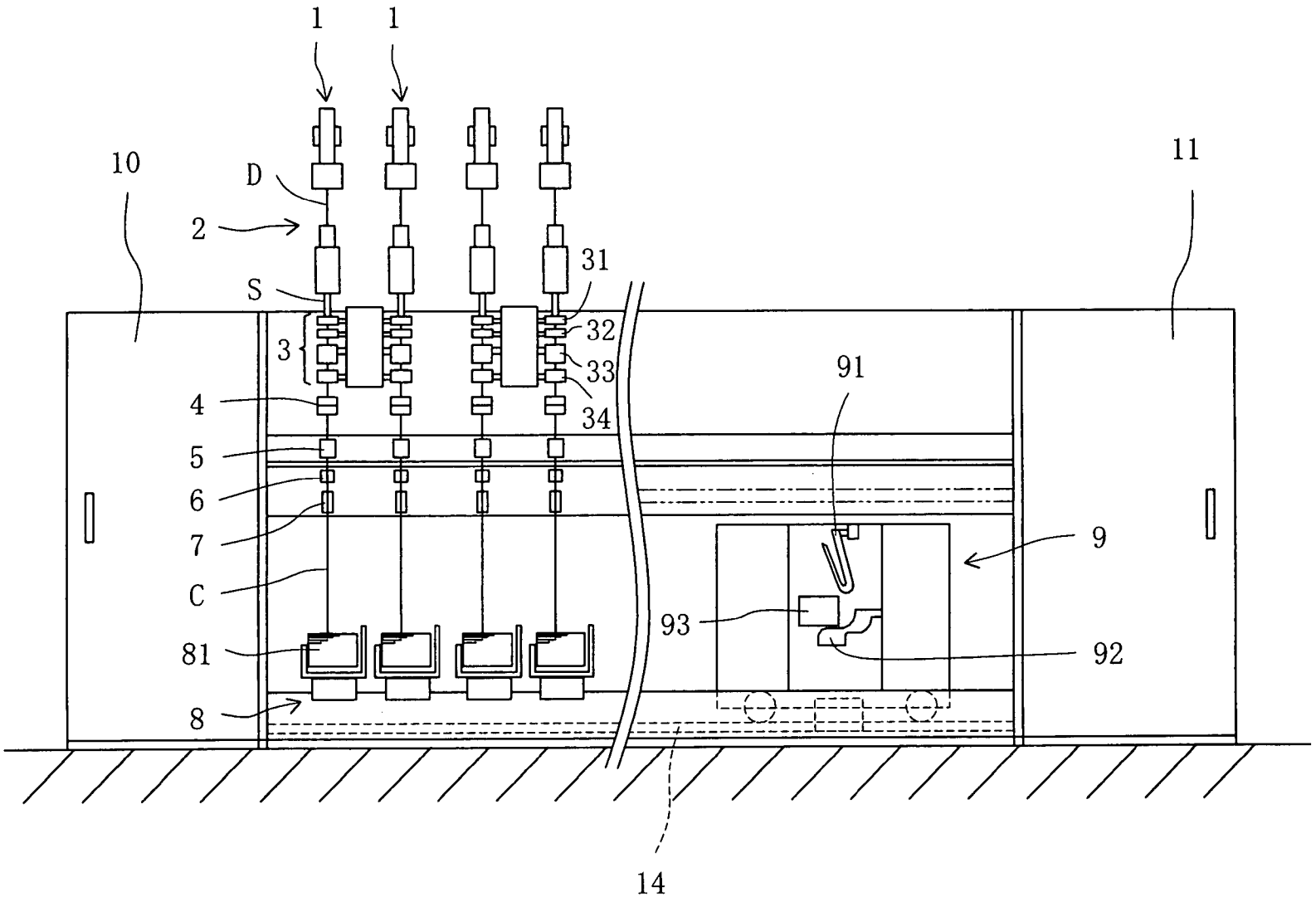
FIG. 1 is a general front view illustrating a core yarn spinning machine.

Referring to FIG. 1, the core yarn spinning machine has a number of spinning units (yarn processing units) 1 arranged between a motor box 10 and a dust box 11. Further, the core yarn spinning machine is provided with a rail 14 along which each spinning unit 1 is disposed, such that a yarn splicer carriage 9 can reciprocate horizontally along the rail 14. The yarn splicer carriage 9 travels and stops at a spinning unit 1, which requests yarn splicing, to perform a yarn splicing operation.

Figure 2:
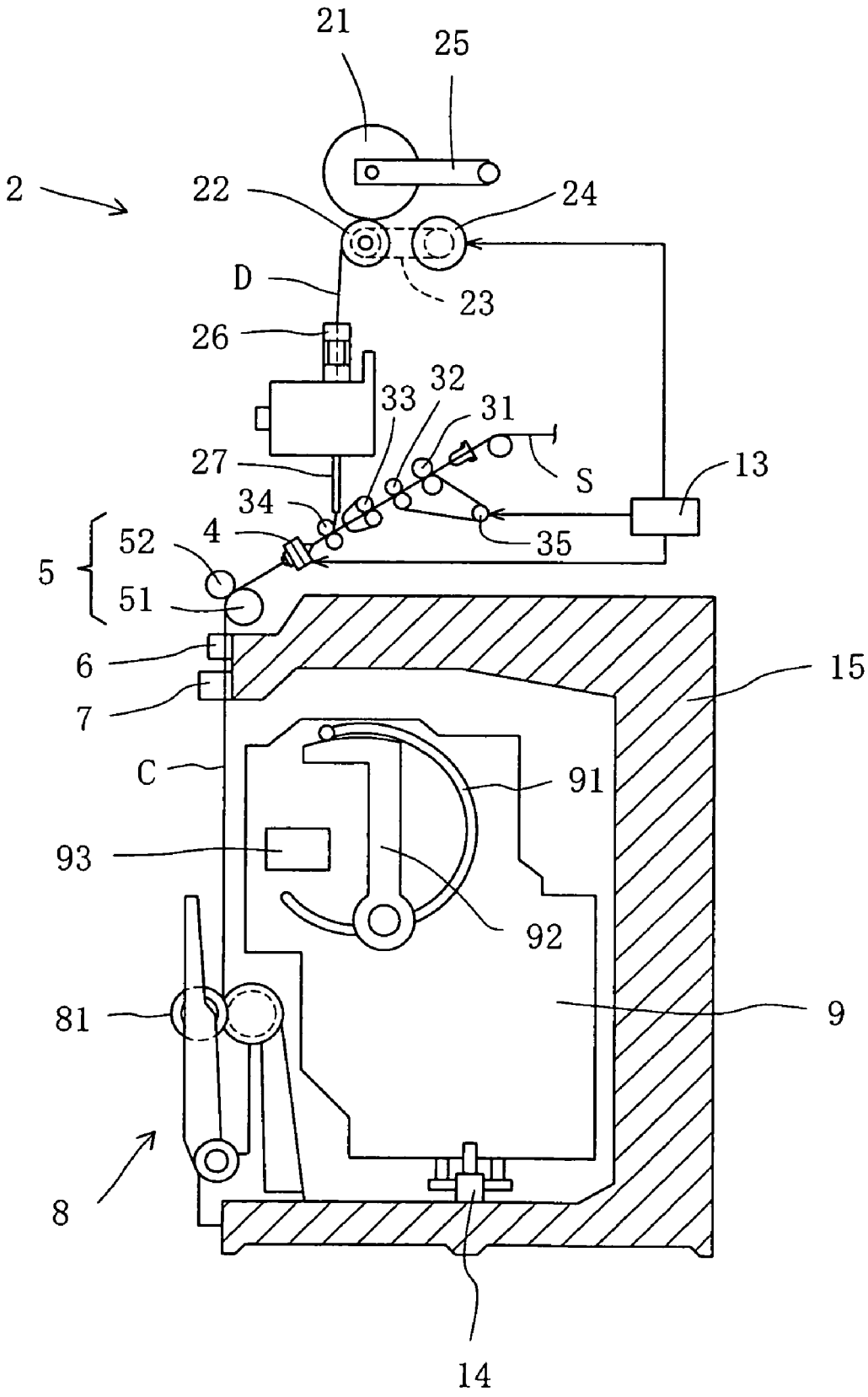
FIG. 2 is a partial cross-sectional side view of FIG. 1.

Referring to FIGS. 1 and 2, each spinning unit 1 includes a drafting device 3, an elastic core fiber supply device 2, a spinning device 4, a yarn feeding device 5 and a take-up device 8. The drafting device 3 includes back rollers 31, third rollers 32, middle rollers 33 and front rollers 34. The elastic core fiber supply device 2 includes an elastic core fiber package 21, etc. The spinning device 4 includes an air jet nozzle, etc., and the take-up device 8 includes a take-up package 81, etc.

A sliver S is unwound from a sliver case (not shown) provided on the back of an apparatus frame 15, and thereafter, supplied to the back rollers 31 and drafted (drawn) by the drafting device 3. Then, an elastic core fiber D from the elastic core fiber supply device 2 is merged with a bundle of fibers between the middle rollers 33 and the front rollers 34 in the drafting device 3. The spinning device 4 applies a swirling flow of compressed air onto the bundle of fibers, thereby spinning a core yarn C having the sliver S as a covering fiber and the elastic core fiber D as a core fiber.

After being fed from the spinning device 4, the core yarn C is fed downward from the yarn feeding device 5 through a cutter device 6 for eliminating a yarn defect and a slub catcher (yarn defect detector) 7 for detecting a yarn defect to the take-up device 8 by which the core yarn C is taken up onto the take-up package 81. The slub catcher 7 has, for example, a function of detecting unevenness in thickness of a yarn and a function of detecting a foreign substance contained in a yarn.

The yarn feeding device 5 is composed of a delivery roller 51 and a nip roller 52 provided in contact with the delivery roller 51. The core yarn C fed from the spinning device 4 is nipped between the delivery roller 51 and the nip roller 52, and fed downward by rotational drive of the delivery roller 51.

The elastic core fiber supply device 2 includes an elastic core fiber package 21 and a rotating roller 22, which rotates in contact with the circumferential surface of the elastic core fiber package 21. The rotating roller 22 is rotated via a belt 23 driven by a drive motor 24. The elastic core fiber package 21 is rotatably supported by cradle arms 25.

The elastic core fiber D is unwound from the elastic core fiber package 21 through the rotation of the rotating roller 22, and caused to pass through a supply guiding tube 27 by a jet of high pressure air from an air sucker device 26. Thereafter, the elastic core fiber D is supplied from the supply guiding tube 27 to a position slightly upstream of the front rollers 34, merged with the bundle of fibers in the drafting device 3, and introduced to the spinning device 4.

The rotational speed of the delivery roller 51 in the yarn feeding device 5 is set higher than that of the rotating roller 22 in the elastic core fiber supply device 2, and therefore, spinning is performed with the elastic core fiber D being stretched (e.g., three times in length).

The yarn splicer carriage 9 includes: a suction pipe (supply side yarn end catching means) 91 for sucking and catching a core yarn C successively supplied from the spinning device 4 on the supply side; a suction mouth (take-up side yarn end catching means) 92 for sucking and catching a core yarn C on the take-up package 81; and a yarn splicing device 93 for splicing together the core yarns C respectively caught by the suction pipe 91 and the suction mouth 92. At the ends of the suction pipe 91 and the suction mouth 92, a suction airflow is generated by a suction flow generating source (not shown) to suck and catch a yarn end. The splicing device 93 is composed of, for example, a clamping member, a cutter member and a splicer (all of which are not shown).

Described next is an operation of, when a yarn defect is detected by the slub catcher, eliminating the yarn defect and performing yarn splicing.

The cutter device 6 and the slub catcher 7 are provided on the front side of the apparatus frame 15 so as to pass therethrough a core yarn C spun by the spinning device 4, whereby any defect of the passing core yarn C can be detected by the slub catcher 7.

Figure 3:
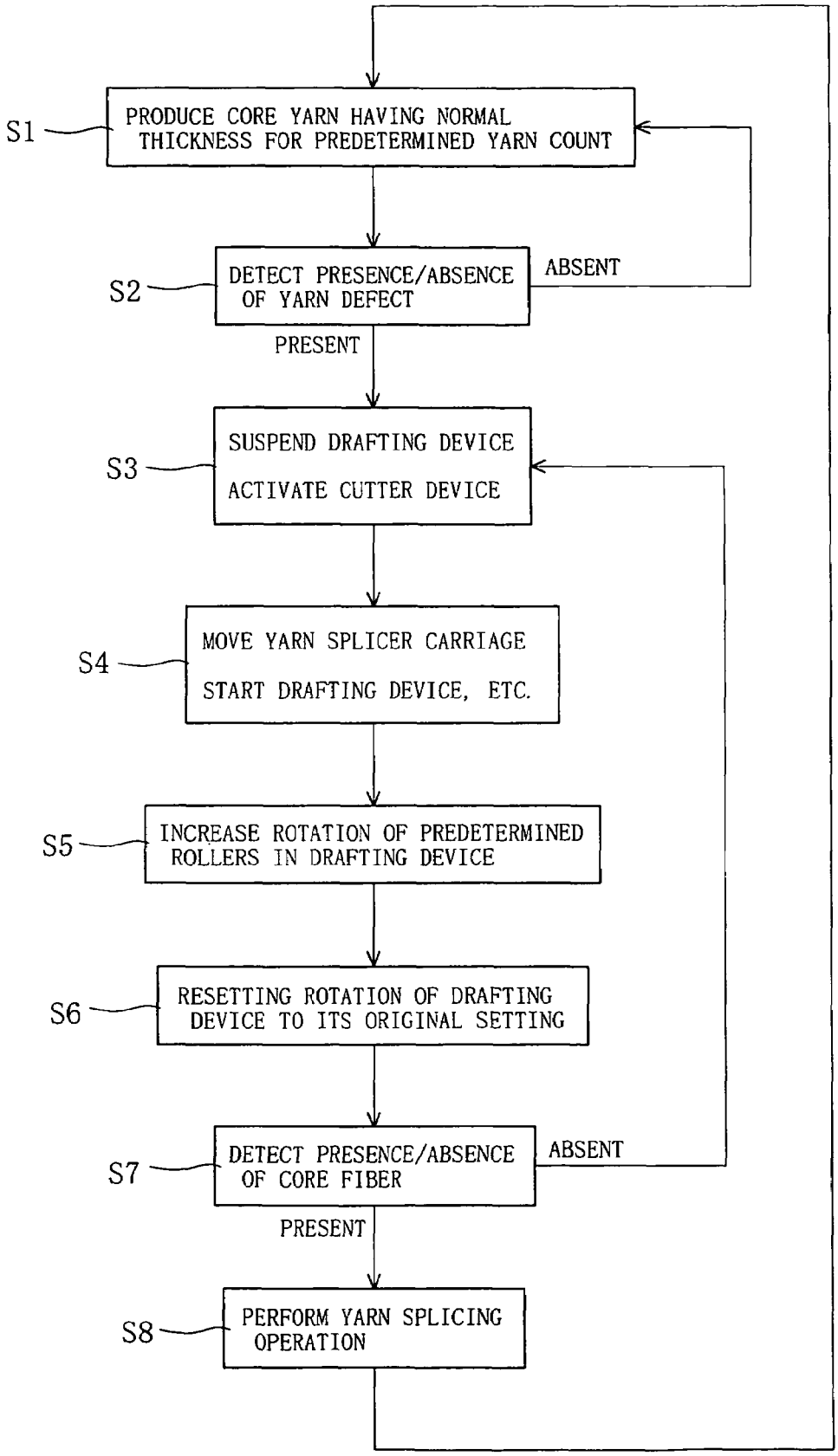
FIG. 3 is a flowchart for explaining a yarn splicing operation, etc.

Referring to FIG. 3, upon detection of a defect of the core yarn C, the slub catcher 7 sends a signal to a spinning unit controller 13 (S2). This signal is intended to provide an instruction to eliminate the defect of the core yarn C and start a subsequent yarn splicing operation.

Immediately after receiving the signal, the spinning unit controller 13 activates the cutter device 6 to cut the core yarn C, and suspends the drafting device 3, the elastic core fiber supply device 2 and the spinning device 4 (S3). Then, the yarn splicer carriage 9 moves to the front of a corresponding spinning unit 1. Thereafter, the spinning unit controller 13 restarts the drafting device 3, the elastic core fiber supply device 2 and the spinning device 4 (S4).

At the same time, the spinning unit controller 13 controls a drive motor 35, which drives the back rollers 31 and the third rollers 32, to increase the rotational speed of the back rollers 31 and the third rollers 32. This allows a sliver S to be supplied to the drafting device 3 in an amount greater than the amount to be taken up, so that the yarn C is spun into a lower count over a predetermined period of time (S5).

Figure 4:
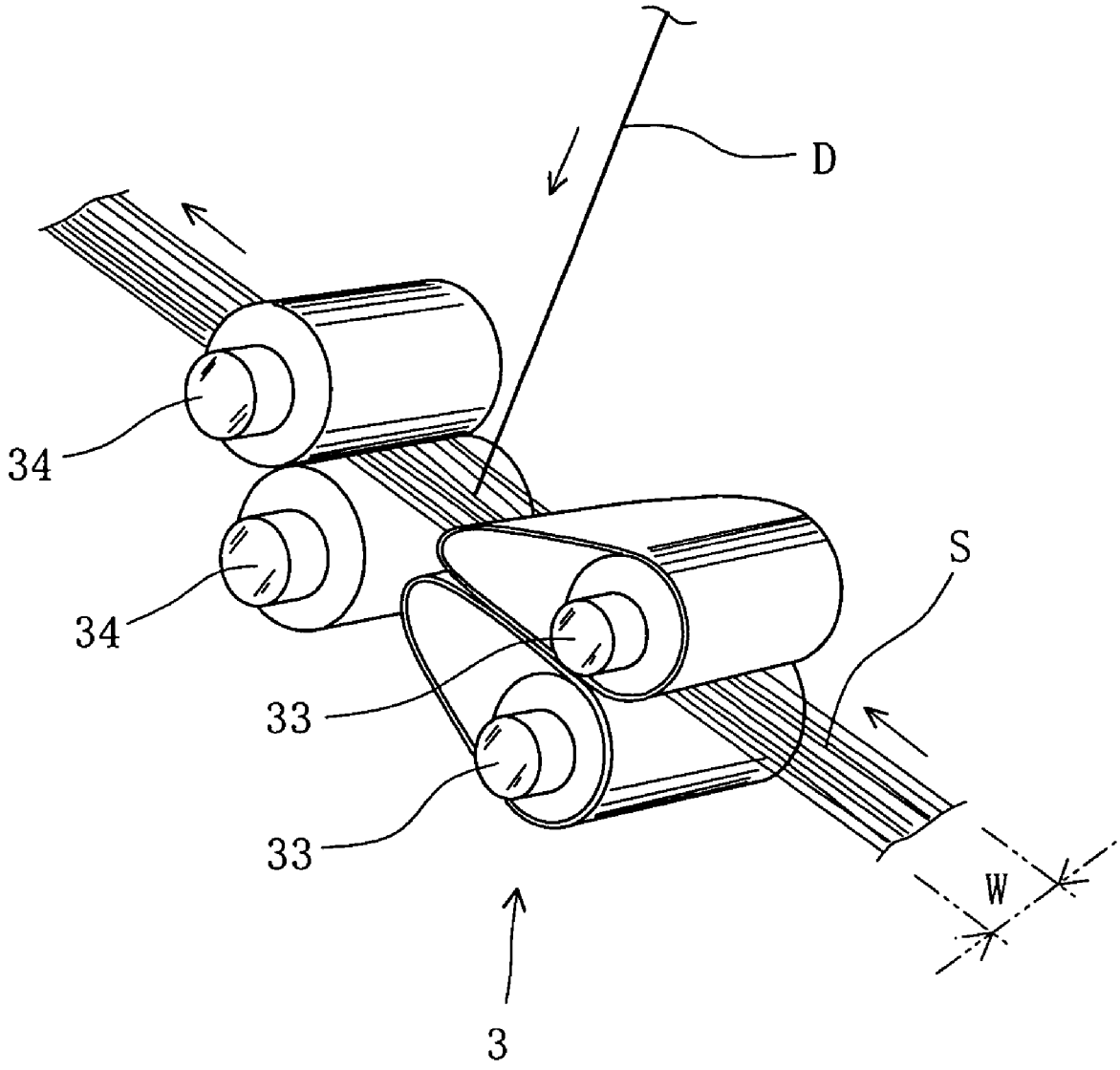
FIG. 4 is a schematic oblique view illustrating a portion including the merging point of a bundle of fibers and a core fiber.

In this manner, by increasing the rotational speed of the back rollers 31 and the third rollers 32 for a predetermined period of time after the spinning is started for yarn splicing, the amount of sliver S that is present between the middle rollers 33 and the front rollers 34 in the drafting device 3 as shown in FIG. 4 is increased. This results in reduced disturbance of the bundle of fibers due to high pressure air from the air sucker device 26, leading to an increased width W of the bundle of fibers between the middle rollers 33 and the front rollers 34. The increased width W of the bundle of fibers makes it easier for the elastic core fiber D from the elastic core fiber supply device 2 to merge with the bundle of fibers positioned upstream of the front rollers 34, so that error in supplying the core fiber is reduced, whereby production of core yarns C having no core fiber can be reduced.

Referring again to FIG. 3, the suction pipe 91 is turned upward to suck and hold the end of the core yarn C at the end of the suction pipe 91, and swung downward. Before yarn splicing is performed, the rotational speed of the back rollers 31 and the third rollers 32 is reset to the original setting, thereby resetting the yarn thickness to the original value (S6), and thereafter, the slub catcher 7 detects the presence or absence of a core fiber D in the core yarn C based on the principle that when the suction power of the suction pipe 91 is reduced to loosen the core yarn C, the yarn shrinks and becomes thicker than its normal thickness (S7).

If the core yarn C is determined to be normal and include an elastic core fiber D, the yarn splicer carriage 9 controls the suction pipe 91, the suction mouth 92 and the splicing device 93 to perform a predetermined yarn splicing operation, thereby eliminating the yarn defect and splicing the end of the core yarn C on the spinning side to the end of the core yarn C on the take-up package 81 side (S8). As such, a core yarn C having a normal thickness for a predetermined yarn count is produced (S1).

On the other hand, if the core yarn C is determined to be defective and include no elastic core fiber D, the slub catcher 7 sends a signal indicating as such to the spinning unit controller 13. Immediately after receiving the signal, the spinning unit controller 13 severs a defective portion of the core yarn with the cutter device 6, and repeats a process as described above (S3 to S6). Alternatively, an abnormality may be reported for suspension, and the operator may manually eliminate the abnormality. Thereafter, when the core yarn C is determined to be normal, the end of the core yarn C on the spinning side is spliced to the end of the core yarn C on the take-up package 81 side (S8) to produce a core yarn C having a normal thickness for a predetermined yarn count (S1).

Although the above embodiment has been described with respect to the case where the core fiber D is an elastic fiber, the present invention is also applicable to a filament core fiber.

The present invention is particularly effective to produce the fine count core yarn (Ne 60 or more). Further more, the present invention can be applicable to producing a medium count core yarn (Ne 30 to Ne 60) and a coarse count core yarn (Ne 30 or less). It is ensured that a core fiber is caught the bundle of fibers when producing not only the fine count core yarn but also the medium count core yarn and the coarse count core yarn.

What is claimed is:

1. A core yarn production method for producing a core yarn by supplying a sliver to a drafting device in a predetermined amount and merging a core fiber with the sliver, wherein the sliver is supplied to the drafting device in an amount greater than the predetermined amount over a predetermined period of time after spinning is started, so as to merge with the core fiber, and thereafter, the sliver is supplied to the drafting device in the predetermined amount.

2. The core yarn production method according to claim 1, wherein an amount of sliver that is supplied to the drafting device is changed in accordance with a rotational speed of predetermined draft rollers in the drafting device.

3. A core yarn production apparatus for producing a core yarn by supplying a sliver to a drafting device in a predetermined amount and merging a core fiber with the sliver, the apparatus comprising:

means for changing an amount of sliver that is supplied to the drafting device; and means for controlling timing of the changing, wherein under control of the controlling means, the sliver is supplied to the drafting device in an amount greater than the predetermined amount over a predetermined period of time after spinning is started, so as to merge with the core fiber, and thereafter, the sliver is supplied to the drafting device in the predetermined amount.

4. The core yarn production apparatus according to claim 3, wherein the changing means adjusts a rotational speed of predetermined draft rollers in the drafting device.

* * * * *